US009140445B2

(12) United States Patent
Tomita et al.

(10) Patent No.: US 9,140,445 B2
(45) Date of Patent: Sep. 22, 2015

(54) SUPERHEATED STEAM GENERATION CONTAINER, SUPERHEATED STEAM GENERATOR, AND SUPERHEATED STEAM GENERATION METHOD

(75) Inventors: Hideo Tomita, Tokyo (JP); Takeshi Maruyama, Tokyo (JP); Shinzo Yoshimura, Tokyo (JP)

(73) Assignee: TOKYO DENKI UNIVERSITY, Tokyo (JP)

( * ) Notice: Subject to any disclaimer, the term of this patent is extended or adjusted under 35 U.S.C. 154(b) by 1463 days.

(21) Appl. No.: 12/195,943

(22) Filed: Aug. 21, 2008

(65) Prior Publication Data

US 2009/0159591 A1 Jun. 25, 2009

(30) Foreign Application Priority Data

Dec. 25, 2007 (JP) ..... 2007-332562

(51) Int. Cl.
*F22B 1/28* (2006.01)
*B24B 49/10* (2006.01)

(52) U.S. Cl.
CPC ..... *F22B 1/284* (2013.01); *B24B 49/105* (2013.01)

(58) Field of Classification Search
CPC ..... H05B 6/108; F22B 1/281; B24B 49/105
USPC ..... 219/628–630, 670, 672, 676–677, 656, 219/687, 688; 392/397, 398, 450; 126/348, 126/377.1, 378.1, 392.1; 122/467; 156/86, 156/497
See application file for complete search history.

(56) References Cited

U.S. PATENT DOCUMENTS

| | | | | |
|---|---|---|---|---|
| 5,240,674 | A * | 8/1993 | Armor | 422/6 |
| 5,990,465 | A * | 11/1999 | Nakaoka et al. | 219/629 |
| 7,115,845 | B2 * | 10/2006 | Nomura et al. | 219/630 |
| 2001/0022094 | A1 * | 9/2001 | Makikawa et al. | 65/379 |
| 2002/0184860 | A1 * | 12/2002 | Sarles et al. | 53/478 |

FOREIGN PATENT DOCUMENTS

| | | |
|---|---|---|
| JP | 08-339883 | 12/1996 |
| JP | 2004-044993 | 2/2004 |
| JP | 2004-044994 | 2/2004 |
| JP | 2006-064367 | 3/2006 |

(Continued)

OTHER PUBLICATIONS

Office Action for JP 2007-332562 mailed Aug. 28, 2012.

*Primary Examiner* — Tu B Hoang
*Assistant Examiner* — Thomas Ward
(74) *Attorney, Agent, or Firm* — Foley & Lardner LLP

(57) ABSTRACT

A superheated steam generator, capable of generating superheated steam which exceeds about 400° C. even if a litz wire is adopted as an induction heating coil, is generally described. The generator may include induction heating elements that can generate heat by electromagnetic induction and that are housed in a heat-resistant container. The generator may also include a hose that allows cooling water to pass therethrough and which is wound around an outer peripheral surface of the heat-resistant container. A water supply unit for the cooling water is connected to one end of the hose, and the other end of the hose is connected to a steam inlet of the heat-resistant container. An induction heating coil is mounted on an outer peripheral surface of the hose, and a high-frequency power supply unit is connected to the induction heating coil.

16 Claims, 18 Drawing Sheets

(56) References Cited

FOREIGN PATENT DOCUMENTS

| | | |
|---|---|---|
| JP | 2006-275505 | 10/2006 |
| JP | 2007-024336 | 2/2007 |
| JP | 2007-143550 | 6/2007 |
| JP | 2007-147114 | 6/2007 |

* cited by examiner

Fig.10

TABLE 1 SPECIFICATION OF PUMP USED

| | |
|---|---|
| MAKER | FURUE SCIENCE |
| MODEL NO. | RP-PA(DC) |
| MOTOR | DC MOTOR FK20GH DC 12V |
| ROTATIONAL FREQUENCY OF HEAD | 72RPM (RATED ROTATIONAL FREQUENCY) |
| DISCHARGE PRESSURE | 0.05 MPa |
| TUBE USED | HIGH - STRENGTH SILICONE 4.0×5.6 (mm) OTHER PHARMED |
| HEAT - RESISTANCE | HIGH - STRENGTH SILICONE ~150℃ |
| POWER | DC 12V |
| DIMENSION/WEIGHT | 52W×90D×101H (mm)/200g |

Fig.11

TABLE 2 FLOW RATE OF PUMP USED

| VOLTAGE V[V] | FLOW RATE (mL/min) |
|---|---|
| 3 | ABOUT 10 |
| 5 | ABOUT 17 |
| 12 | ABOUT 40 |

Fig.12

TABLE 3 SPECIFICATION OF LITZ WIRE

| MAKER | TOTOKUMAKISEN |
|---|---|
| MODEL NO. | 2 - SFBW |
| SHAPE OF WIRE | Φ0.14×33×7 |

SUPERHEATED STEAM GENERATION CONTAINER, SUPERHEATED STEAM GENERATOR, AND SUPERHEATED STEAM GENERATION METHOD

CROSS-REFERENCES TO RELATED APPLICATIONS

The entire disclosure of Japanese Patent Application No. 2007-332562, filed on Dec. 25, 2007, is expressly incorporated herein by reference.

BACKGROUND OF THE INVENTION

1. Technical field

The present invention relates to a superheated steam generation container generating superheated steam by induction heating, a superheated steam generator utilizing this superheated steam generation container as a main component, and a superheated steam generation method of generating superheated steam using this superheated steam generation container.

2. Related Art

In recent years, an electronic microwave oven utilizing superheated steam has appeared on the market. Water is boiled at 100° C. at standard pressure to generate water vapor. The high-temperature superheated steam largely exceeding 100° C. can be obtained by removing moisture from this water vapor so as to be perfect gas, and further heating the water vapor. Cooking with no burn marks is allowed for a short time by heating food with this superheated steam. Further, the superheated steam can be utilized as a heat source for heating, sterilization, and disinfection of medical equipment.

As superheated steam generators which generate such superheated steam, for example, high-frequency heating apparatuses with a steam generating function are disclosed in Japanese Patent Application Laid-Open No. 2004-44993 (Patent Document 1), Japanese Patent Application Laid-Open No. 2004-44994 (Patent Document 2), and Japanese Patent Application Laid-Open No. 2006-275505 (Patent Document 3). However, these create superheated steam by heater heating, and do not create superheated steam by the induction heating by a high-frequency induction coil.

Further, superheated steam generators which introduce the steam generated within a high-frequency heating container into a conductor which forms a shield coil, reheating the introduced steam by an induction coil so as to be superheated steam, and extracting the superheated steam are also known (Japanese Patent Application Laid-Open No. 2006-64367: Patent Document 4, Japanese Patent Application Laid-Open No. 2007-147114: Patent Document 5). However, the structure in which cooling water is heated into steam by allowing the water to pass through a hose wound around an outer peripheral surface of the heating container and at the same time the heat of the surface of the heating container is insulated from a high-frequency heating coil by the cooling water is not seen.

Moreover, a related-art technique disposed in Japanese Patent Application Laid-Open No. 2007-24336 (Patent Document 6) has a feature in the winding structure of an induction heating coil mounted on an outer periphery of a heat-resistant container. However, even in this related art, the structure in which cooling water is heated into steam by allowing the water to pass through a hose wound around an outer peripheral surface of the heating container and at the same time the heat of the surface of the heating container is insulated from a high-frequency heating coil by the cooling water is not seen.

For example, in the case of a middle-sized or home-available superheated steam generator, it is necessary to avoid enlargement of the apparatus, and it is conceivable to adopt a litz wire as the induction heating coil. Here, when the induction heating elements in the heating container are induction-heated, the outer surface temperature of the heating container also becomes high temperature by the generation of heat of the elements. Thus, when a litz wire is adopted as the induction heating coil, the coating of the litz wire may melt easily. As a result, the apparatus which generates superheated steam which exceeds 400° C. cannot be used practically.

SUMMARY

The invention has been made in view of the problems of the above related-art technique, and the object of the invention is to provide a superheated steam generation container, a superheated steam generator using the container as a component, and a superheated steam generation method, capable of generating superheated steam which exceeds 400° C. even if a litz wire is adopted as the induction heating coil, and capable of being used as a middle-sized or small-sized-sized home-available apparatus.

One feature of the invention is a superheated steam generation container in which induction heating elements which generates heat by electromagnetic induction are housed in a heat-resistant container, a hose which allows cooling water to pass therethrough is wound around an outer peripheral surface of the heat-resistant container, and an induction heating coil is mounted on an outer peripheral surface of the hose.

In the above superheated steam generation container of the invention, the outer peripheral surface of the heat-resistant container can be covered with a heat-resistant member, and the hose can be wound around the outer peripheral surface of the heat-resistant tube.

Further, in the above superheated steam generation container of the invention, a litz wire can be used as the induction heating coil.

Further, in the above superheated steam generation container of the invention, a quartz glass container can be used as the heat-resistant container.

Another feature of the invention is a superheated steam generator in which induction heating elements which generates heat by electromagnetic induction are housed in a heat-resistant container, a hose which allows cooling water to pass therethrough is wound around an outer peripheral surface of the heat-resistant container, a water supply unit for the cooling water is connected to one end of the hose, the other end of the hose is connected to a steam inlet of the heat-resistant container, an induction heating coil is mounted on an outer peripheral surface of the hose, and a high-frequency power supply unit is connected to the induction heating coil.

In the above superheated steam generator of the invention, a heat-resistant tube can be mounted on the outer peripheral surface of the heat-resistant container, and the hose can be wound around the outer peripheral surface of the heat-resistant tube.

Further, in the above superheated steam generator of the invention, a litz wire can be used as the induction heating coil.

Further, in the above superheated steam generator of the invention, a quartz glass container can be used as the heat-resistant container.

Still another feature of the invention is a superheated steam generation method including, with a superheated steam generation container in which induction heating elements which generates heat by electromagnetic induction are housed in a heat-resistant container, a hose which allows cooling water to pass therethrough is wound around an outer peripheral surface of the heat-resistant container, and an induction heating coil is mounted on an outer peripheral surface of the hose, allowing cooling water to pass therethrough, applying high-frequency electric current to the induction heating coil, thereby induction-heating the induction heating elements, and induction-heating of the cooling water within the hose into steam, and introducing the steam of the cooling water into the heat-resistant container, and heating the steam by the induction heating elements, thereby generating superheated steam.

According to the superheated steam generation container of the invention, a superheated steam generator can be constructed by connecting a water supply unit to one end of the hose wound around the outer peripheral surface of the heat-resistance container, connecting the other end of the hose to a steam inlet of the heat-resistant container, and connecting an induction heating coil mounted outside the hose to a high-frequency power supply unit. By operating this superheated steam generator to supply high-frequency electric power to the induction heating coil while supplying water to the hose, the induction heating elements within the heat-resistant container can be induction-heated to high temperature by the induction heating coil, and simultaneously, the cooling water within the hose can also be induction-heated into steam. Then, by introducing the steam into the heat-resistant container from the steam inlet, and bringing the steam into contact with the induction heating elements heated to high temperature there to further heat the steam, superheated steam can be generated. Simultaneously, the water which flows through the inside of the hose exhibits a cooling action during this induction heating to cool down the outer surface of the heat-resistant container and to prevent high heat from being transmitted to the induction heating coil from the outer surface of the heat-resistant container. Accordingly, a middle-sized or small-sized home-available superheated steam generator capable of avoiding using a high heat-resistant conducting material for the induction heating coil, avoiding enlargement of the superheated steam generator, and generating superheated steam exceeding 400° C. is obtained.

According to the superheated steam generator and the superheated steam generation method of the invention, high-frequency electric power is supplied to the induction heating coil while supplying water to the hose. Thereby, superheated steam can be generated within the heat-resistant container, and simultaneously, the outer surface of the heat-resistant container can be cooled down by the water which flows through the inside of the hose, thereby preventing high heat from being transmitted to the induction heating coil from the outer surface of the heat-resistant container. Thus, a middle-sized or small-sized home-available apparatus capable of avoiding using a high heat-resistant conducting material for the induction heating coil, and therefore avoiding enlargement of the apparatus, and generating superheated steam exceeding 400° C. is obtained.

BRIEF DESCRIPTION OF THE DRAWINGS

FIG. 10 is a diagram illustrating Table 1 of the specifications of a water supply pump and the heat-resistant hose, which are used in Example 1 of the invention.

FIG. 11 is a view illustrating Table 2 of the flow rate of the water supply pump used in the above Example 1.

FIG. 12 is a view illustrating Table 3 of the specification of a litz wire used for manufacture of induction heating coil in the above Example 1.

DESCRIPTION OF EXEMPLARY EMBODIMENTS

Hereinafter, embodiments of the invention will be described in detail with reference to the drawings.

First Embodiment

Figure 1:
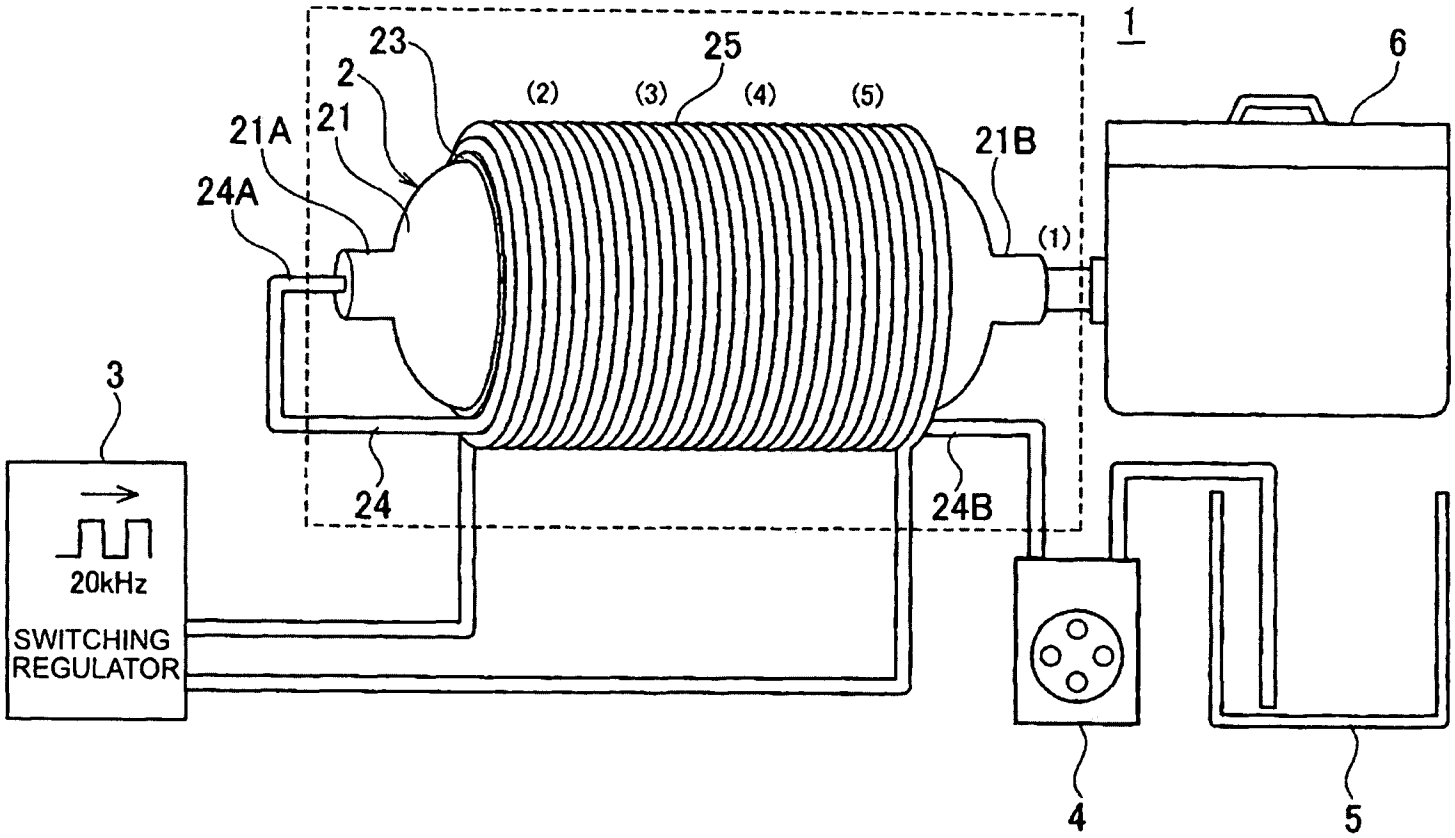
FIG. 1 is a block diagram of a superheated steam generator of first and second embodiments of the invention.
Figure 2:
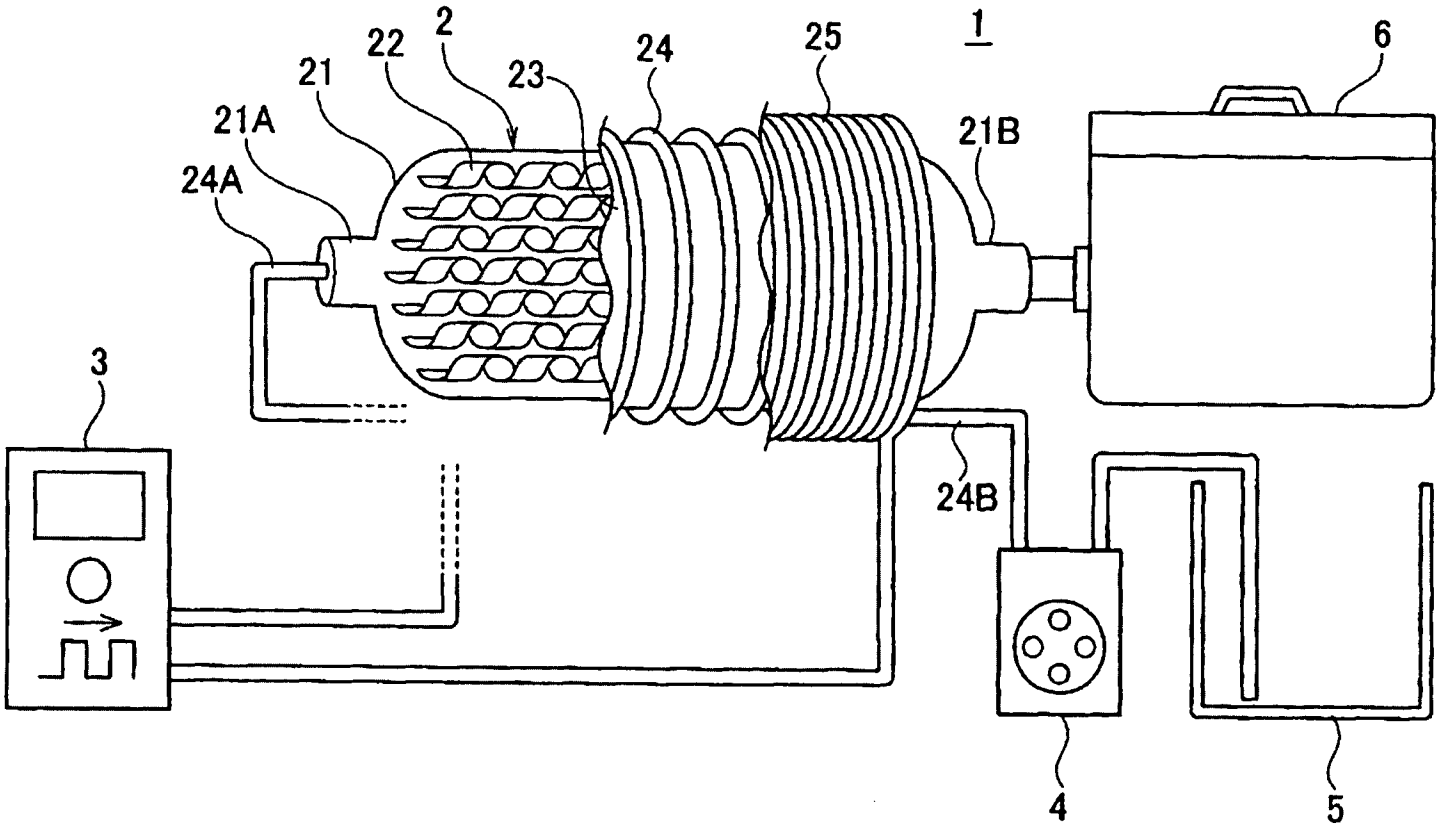
FIG. 2 is a partially cross-sectioned block diagram of the superheated steam generator of the first embodiment of the invention.

Referring to FIG. 1 to FIG. 6, a superheated steam generator of a first embodiment of the invention, a superheated steam generation container used for this generator, and a superheated steam generation method using this container will be described. As shown in FIG. 1 and FIG. 2, the superheated steam generator 1 of this embodiment includes a superheated steam generation container 2, a high-frequency power supply unit 3, a water supply pump 4, and a water supply tank 5, and a steam boiler 6 for utilizing the superheated steam generated in the superheated steam generation container 2 is connected to the superheated steam generation container 2.

Figure 3:
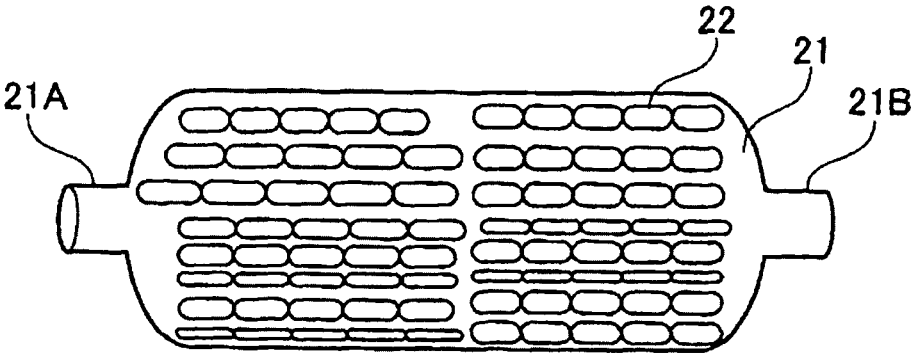
FIG. 3 is a front view of a heat-resistant container in the superheated steam generation container of the first embodiment of the invention.
Figure 4:
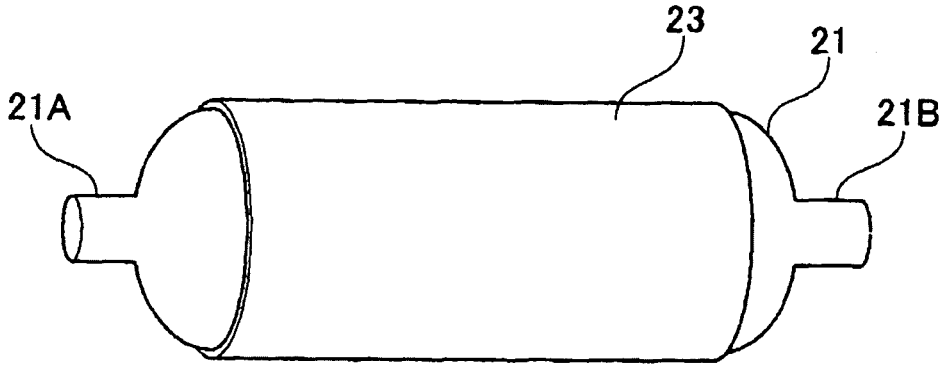
FIG. 4 is a front view in a state where a heat insulating material is coated on an outer periphery of the heat-resistant container in the superheated steam generation container of the above first embodiment.
Figure 5:
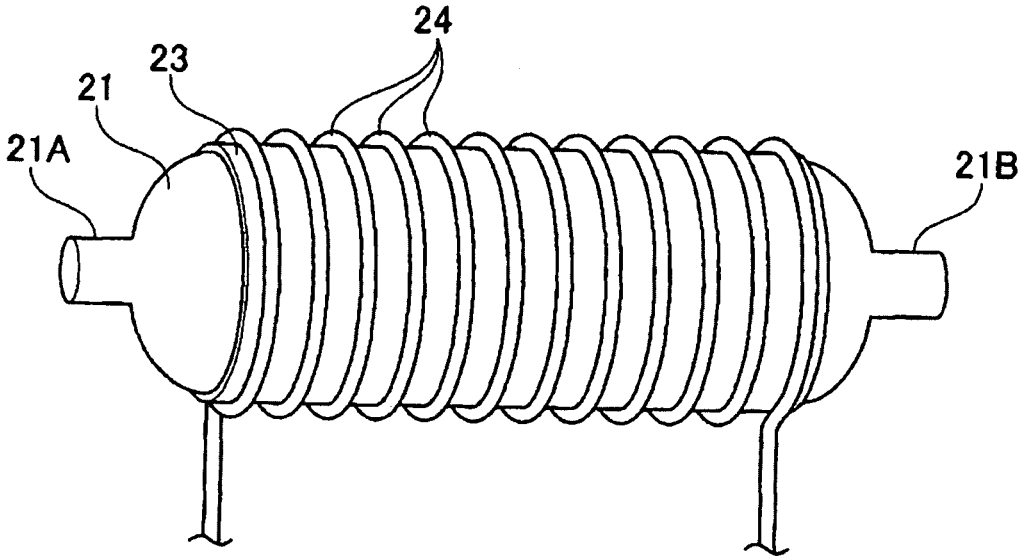
FIG. 5 is a front view in a state where a heat-resistant hose is wound around the outer periphery of the heat-resistant container in the superheated steam generation container of the above first embodiment.
Figure 6:
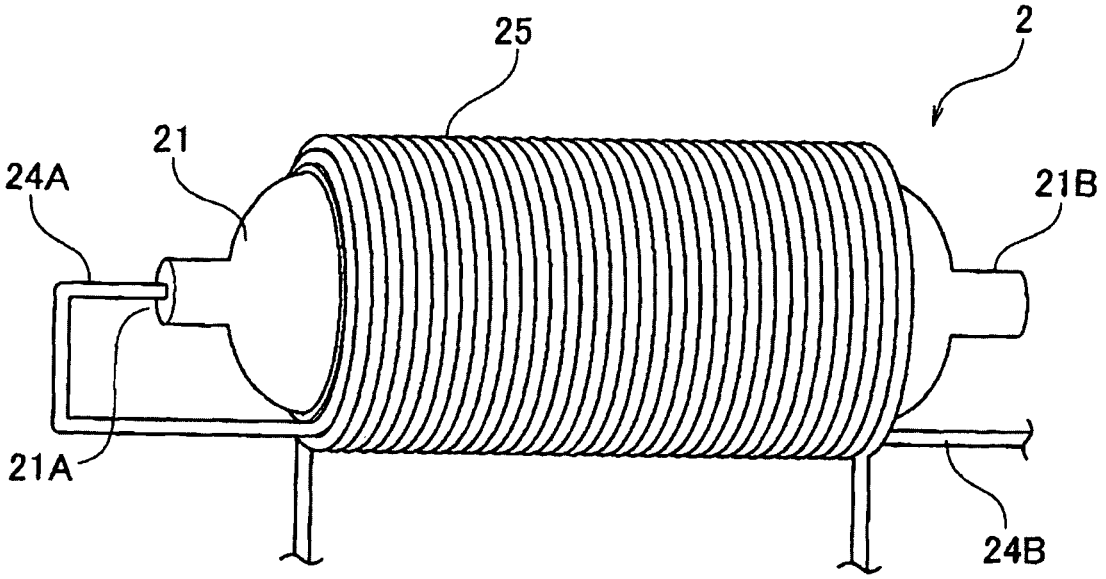
FIG. 6 is a front view of the superheated steam generation container of the above-mentioned first embodiment.

In the superheated steam generation container 2, induction heating elements 22 which generate heat by electromagnetic induction are housed within a nonmagnetic heat-resistant container 21 like a quartz glass container as shown in FIG. 3, an outer periphery of the heat-resistant container 21 is covered-with a heat insulating material 23 like a schamotte brick as shown in FIG. 4, a heat-resistant hose 24 like a silicone hose for allowing cooling water to pass therethrough is wound around an outer periphery of the heat insulating material 23 in such density that induction heating coil 25 mounted on the outside of the hose does not contact the inner heat insulating material 23 as shown in FIG. 5, and the induction heating coil 25 is arranged outside the heat-resistant hose 24 as shown in FIG. 6. One end 24A of the heat-resistant hose 24 is airtightly connected to a steam inlet 21A of the heat-resistant container 21, and the other end 24B thereof is connected to the water supply pump 4.

The induction heating elements 22 are obtained by making fine cuts in, for example, a magnetic stainless strip and twisting the resulting strip, and a proper number of induction heating elements are housed inside the heat-resistant container 21. As the induction heating elements 22, those having the structure in which a number of circular fins like a turbine blade are superimposed on each other can be used, but the induction heating elements are not particularly limited.

As the induction coil 25, for example, a polyurethane coating litz wire is used, or if necessary, a polyethylene coating litz wire is used though expensive. The use of the induction heating elements is not limited to the use of this litz wire. In the case of the invention, the heat-resistant hose 24 is wound inside the induction heating coil 25, and thus the high heat of the heat-resistant container 21 is cooled down. Therefore, a litz wire whose thermal resistance is not high can be used, and thereby, the price of the apparatus can be reduced.

For example, a power unit which generates high-frequency power, like a 20-kHz switching regulator, is used as the high-frequency power supply unit 3.

Next, the operation of generating superheated steam by the superheated steam generator 1 of the above-mentioned configuration will be described. The high-frequency power supply unit 3 is started, thereby applying an electric current to the induction heating coil 25, and starting induction heating. Also, the water supply pump 4 is started to allow cooling water to pass through the heat-resistant hose 24. By applying high-frequency power to the induction heating coil 25, the cooling water within the heat-resistant hose 24 and the induction heating elements 22 in the heat-resistant container 21 are induction-heated. The cooling water within the heat-resistant hose 24 is boiled by this induction heating, and becomes moisture-containing water vapor of 100° C., and is fed into the heat-resistant container 21 from the steam inlet 21A.

Since the induction heating elements 22 are induction-heated to a high-temperature state within the heat-resistant container 21, the water vapor fed from the steam inlet 21A contacts the induction heating elements 22 in a high-temperature state, and is re-heated to become perfect water vapor. This perfect water vapor is further heated to become superheated steam. This superheated steam is delivered to the outside from a steam outlet 21B. The superheated steam delivered from the steam outlet 21B in this way is fed into the steam boiler 6 to heat an object to be heated, which is placed in the steam boiler 6, by high-temperature superheated steam.

Since the inside of the heat-resistant hose 24 wound around the outer periphery of the heat-resistant container 21 is filled with water vapor including moisture, the heat-resistant hose does not exceed about 100° C. during such superheated steam generation operation of the superheated steam generator 1. For this reason, even if the inside of the heat-resistant container 21 is heated by the high temperature of 500° C., the high heat of the heat-resistant container can be cooled down by the heat-resistant hose 24, and is not transmitted to the induction heating coil 25 outside the heat-resistant hose 24. Therefore, the temperature of the induction heating coil 25 is not raised to a high temperature at which an electric wire material or coating is damaged.

Thus, according to the superheated steam generator of this embodiment, the heat-resistant hose 24 can be maintained in a temperature state of 100° C. or less by passing cooling water through the heat-resistant hose 24 wound around the outer periphery of the heat-resistant container 21, and damage of the induction heating coil 25 disposed outside this heat-resistant hose 24 by transfer of the high heat from the heat-resistant container 21 does not occur. Therefore, a litz wire whose thermal resistance is comparatively low can be utilized as the induction heating coil 25, and miniaturization of then apparatus can be achieved.

Second Embodiment

Figure 7:
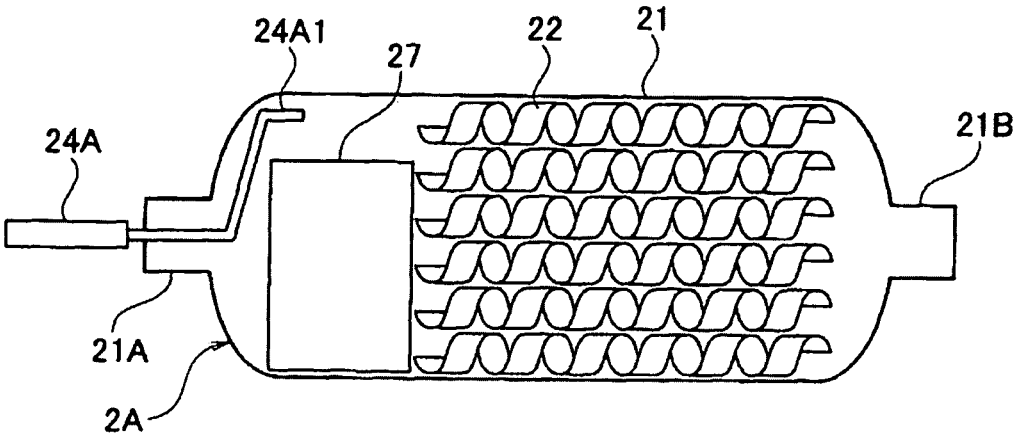
FIG. 7 is a front view of a superheated steam generation container of a second embodiment of the invention.

Referring to FIG. 7, a superheated steam generator of a second embodiment of the invention, a superheated steam generation container used for this generator, and a superheated steam generation method using this container will be described. The second embodiment has features in the structure of a superheated steam generation container 2A. That is, as shown in FIG. 7, in the superheated steam generation container 2A, induction heating elements 22 which generates heat by electromagnetic induction is housed within a nonmagnetic heat-resistant container 21 like a quartz glass container, an input water storage tank 27 of a magnetic material is provided on the side of a steam inlet 21A within the heat-resistant container 21, and a connecting end 24A1 of the heat-resistant hose 24 is introduced to an upper position of the input water storage tank 27. Here, since the inside of the heat-resistant container 21 is in a high-temperature state, materials having non-magnetism and high-temperature resistance, for example, ceramic or copper pipes are used as the connecting end 24A1.

In addition, the other configurations in this embodiment are the same as those of the first embodiment. That is, an outer periphery of the heat-resistant container 21 is covered with a heat insulating material 23 like a schamotte brick as shown in FIG. 4, a heat-resistant hose 24 like a silicone hose for allowing cooling water to pass therethrough is wound around an outer periphery of the heat insulating material 23 in such density that induction heating coil 25 mounted on the outside of the hose does not contact the inner heat insulating material 23 as shown in FIG. 5, and the induction heating coil 25 is arranged outside the heat-resistant hose 24 as shown in FIG. 6. A heat-resistant metallic pipe is connected to one end 24A of the heat-resistant hose 24, and this metallic pipe is airtightly connected to the steam inlet 21A of the heat-resistant container 21 as the connecting end 24A1.

The induction heating elements 22 of this embodiment are also the same as those of the first embodiment, and are obtained by making fine cuts in, for example, a magnetic stainless strip and twisting the resulting strip, and a proper number of induction heating elements are housed inside the heat-resistant container 21. As the induction heating elements 22, those having the structure in which a number of circular fins like a turbine blade are superimposed on each other can be used, but the induction heating elements are not particularly limited.

The configuration of the superheated steam generator 1 having the superheated steam generation container 2A of this embodiment as a main component is common to the first embodiment shown in FIG. 1 and FIG. 2.

Next, the superheated steam generation operation of the superheated steam generator 1 of this embodiment, i.e., the superheated steam generation method, is the same as that of the first embodiment. However, the following excellent actions and effects are exhibited by providing the input water storage tank 27 in the superheated steam generation container 2A. In a case where the cooling water which has been supplied by the water supply pump 4 and has been subjected to induction heating while passing through the inside of the heat-resistant hose 24 is supplied into the heat-resistant container 21 from the steam inlet 21A without sufficient boiling, only moisture is dropped from the connecting end 24A1 of the heat-resistant hose 24, and is temporarily stored in the input water storage tank 27 so that the moisture may not be diffused into the heat-resistant container 21. Since the input water storage tank 27 is made of a magnetic material, the tank is induction-heated along with the induction heating elements 22, and the stored water within the tank 27 boils and is vaporized. This vaporized water vapor is moved toward the induction heating elements 22 along with the water vapor supplied from the connecting end 24A1 of the heat-resistant hose 24, is brought into contact with the induction heating elements 22 heated to high temperature, and is turned into superheated steam.

In a case where there is no input water storage tank 27, the apparatus is not warmed up especially in an early stage of starting. Thus, the cooling water allowed to pass through the heat-resistant hose 24 from the water supply tank 5 by the water supply pump 4 flows through the inside of the heat-resistant hose 24 without boiling as it is, and flows into the heat-resistant container 21 in an air-liquid mixed state or in a liquid state from the connecting end 24A1. The water which has flown into the container may be uniformly dispersed toward a superheated steam outlet 21B from the steam inlet 21A within the heat-resistant container 21, and output steam temperature may fall. Thus, diffusion of the moisture within the heat-resistant container 21 can be prevented by provided the input water storage tank 27 made of a magnetic material itself, which becomes an object to be heated, on the side of the steam inlet 21A. Further, the water which is stored in the input water storage tank 27 and is boiled therein can be allowed to pass through the induction heating elements 22 as water vapor and be tuned into superheated steam, until the cooling water within the heat-resistant hose 24 boils. As a result, the superheated steam of a desired temperature can be effectively generated from the early stage of starting, and thermal efficiency can be improved.

Third Embodiment

Figure 8:
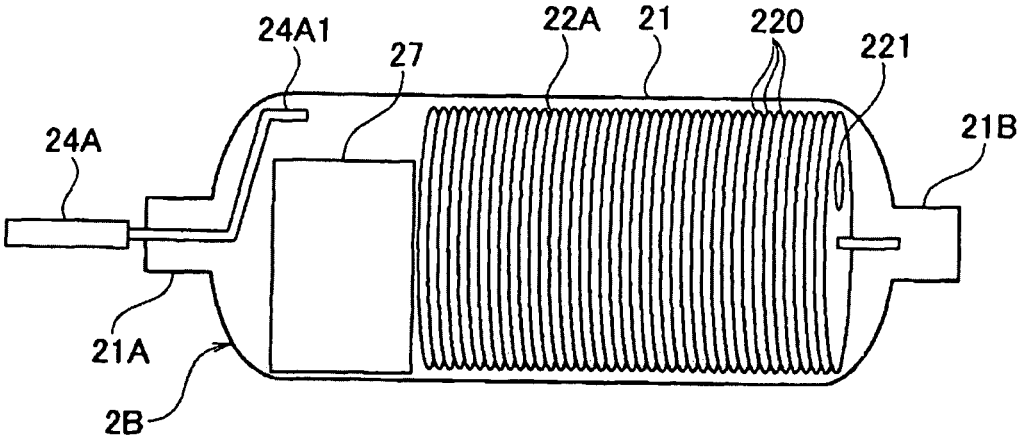
FIG. 8 is a front view of a superheated steam generation container of a third embodiment of the invention.
Figure 9:
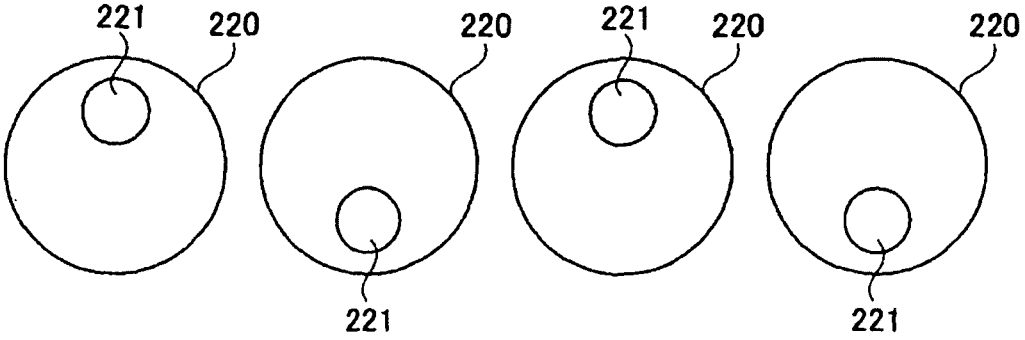
FIG. 9 is an explanatory diagram illustrating the arrangement of a steam passage port of each circular fin in the superheated steam generation container of the above third embodiment.

Referring to FIG. 8 and FIG. 9, a superheated steam generator of a third embodiment of the invention, a superheated steam generation container used for this generator, and a superheated steam generation method using this container will be described. The third embodiment has features in the structure of a superheated steam generation container 2B. That is, as shown in FIG. 8, in the superheated steam generation container 2B, induction heating elements 22A which generates heat by electromagnetic induction is housed within a nonmagnetic heat-resistant container 21 like a quartz glass container, an input water storage tank 27 of a magnetic material is provided on the side of a steam inlet 21A within the heat-resistant container 21, and a connecting end 24A1 of the heat-resistant hose 24 is introduced to an upper position of the input water storage tank 27. Here, since the inside of the heat-resistant container 21 is in a high-temperature state, materials having non-magnetism and high-temperature resistance, for example, ceramic or copper pipes are used as the connecting end 24A1.

In addition, the other configurations in this embodiment are the same as those of the first embodiment. That is, an outer periphery of the heat-resistant container 21 is covered with a heat insulating material 23 like a schamotte brick as shown in FIG. 4, a heat-resistant hose 24 like a silicone hose for allowing cooling water to pass therethrough is wound around an outer periphery of the heat insulating material 23 in such density that induction heating coil 25 mounted on the outside of the hose does not contact the inner heat insulating material 23 as shown in FIG. 5, and the induction heating coil 25 is arranged outside the heat-resistant hose 24 as shown in FIG. 6. A heat-resistant metallic pipe is connected to one end 24A of the heat-resistant hose 24, and this metallic pipe is airtightly connected to the steam inlet 21A of the heat-resistant container 21 as the connecting end 24A1.

As the induction heating elements 22A in this embodiment, those having the structure in which a number of circular fins 220 like a turbine blade are superimposed on each other with a steam passage port 221 can be used. Also, as shown in detail in FIG. 9, a steam passage port 221 in each circular fin 220 is arranged so as to deviate in position from an adjacent circular-fin 220. As a result, the steam which flows to the superheated steam outlet 21B from the steam inlet 21A within the heat-resistant container 21 makes good contact with each circular fin 220 heated to high temperature, and exchanges heat therewith, and is efficiently heated so as to be superheated steam.

The superheated steam generation operation of the superheated steam generator of this embodiment, i.e., the superheated steam generation method, is the same as that of the first embodiment. Here, by providing the input water storage tank 27 within the superheated steam generation container 2B, similarly to the second embodiment, the superheated steam of a desired temperature can be effectively generated from the early stage of starting, and thermal efficiency can be improved. Additionally, by using those having the structure in which a number of circular fins 220 with a hole like a turbine blade are superimposed on each other as the induction heating elements 22A, there is an advantage that temperature rise by induction heat generation can be made high, and superheated steam temperature can be made high.

Next, examples of the invention will be described.

EXAMPLE 1

Figure 13:
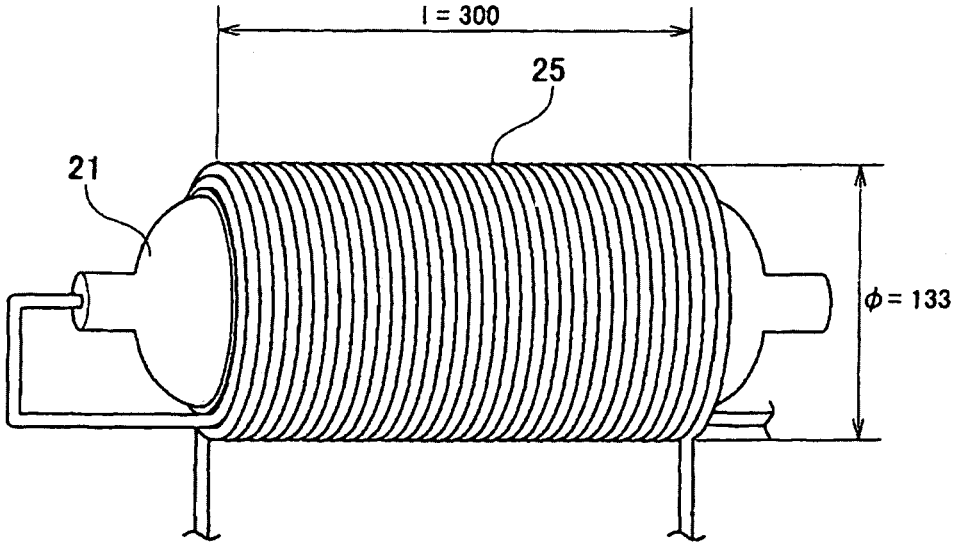
FIG. 13 is a dimensional diagram of the superheated steam generation container used in the above Example 1.
Figure 14:
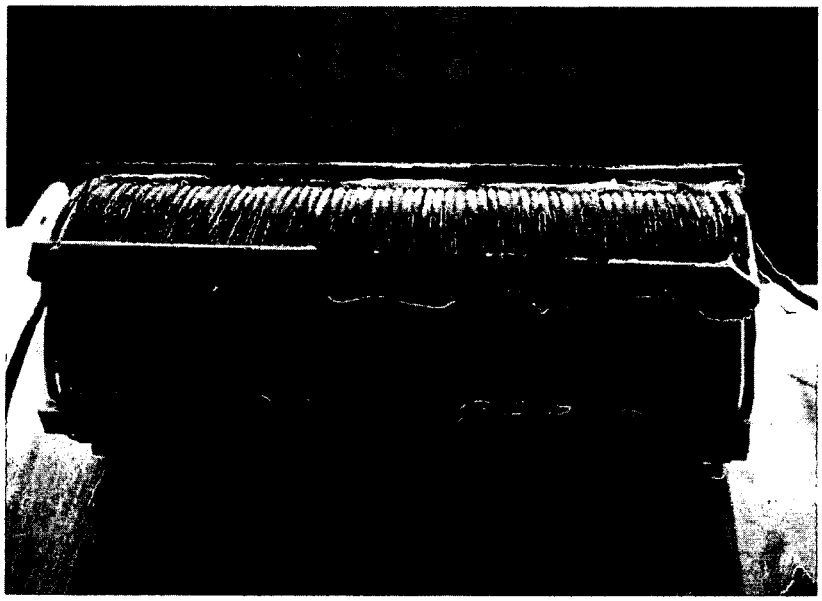
FIG. 14 is a front photography of the induction heating coil unit used for the superheated steam generator of the above Example 1.
Figure 15:
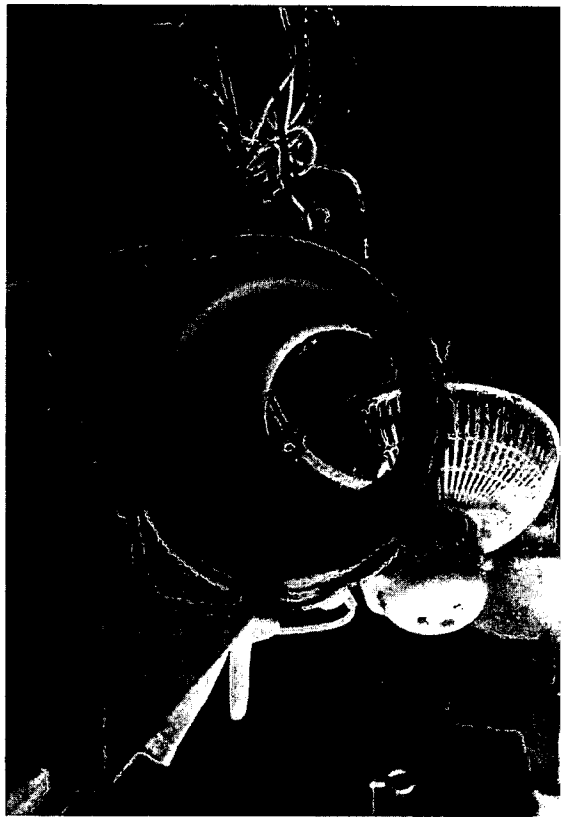
FIG. 15 is a side photography of the induction heating coil unit used for the superheated steam generator of the above Example 1.
Figure 16:
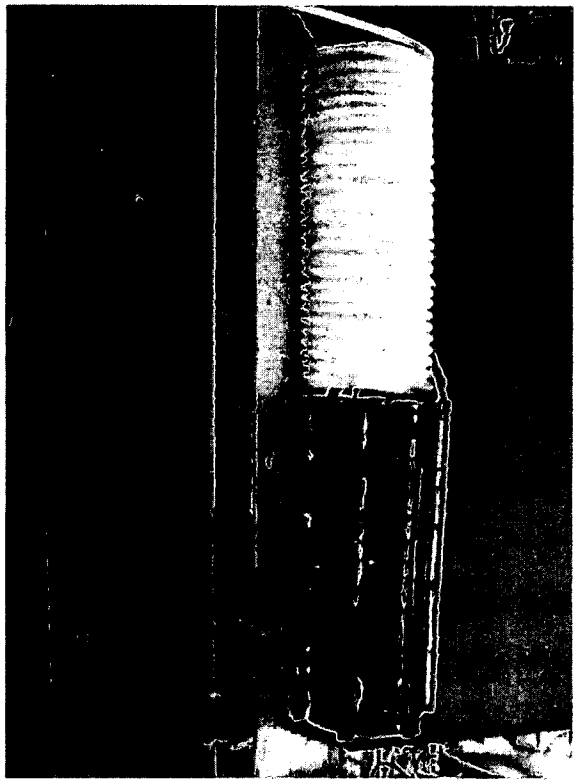
FIG. 16 is a front photography in an exploded state of the induction heating coil unit used for the superheated steam generator of the above Example 1.

The specifications of the water supply pump and the heat-resistant hose were those shown in Table 1 of FIG. 10 and Table 2 of FIG. 11. A litz wire of the specification shown in Table 3 of FIG. 12 was used for the induction heating coil. A litz wire with a diameter of 0.14 mm, 33 bundles, and 7 twists was formed in a solenoid with an external diameter of 133 mm, and a length of 300 mm like FIG. 13. Induction heating unit was formed by using a schamotte brick tube as a heat insulating material, winding a silicone hose shown in Table 1 as a heat-resistant hose at every interval of 10 mm around the tube, and mounting the solenoid of the above induction heating coil on the outside of the hose. FIG. 14 is a front photography of induction heating unit, FIG. 15 is a side surface photography of the induction heating unit, and FIG. 16 is a front photography in an exploded state of the induction heating unit.

Figure 17:
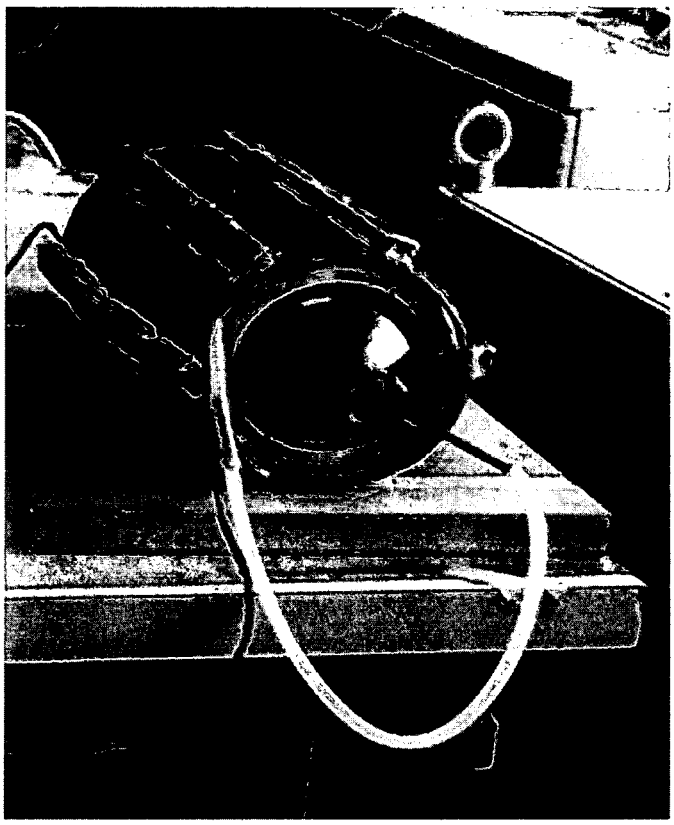
FIG. 17 is a whole photography of the superheated steam generation container used for the superheated steam generator of the above Example 1.

As the superheated steam generation container, one having the structure shown in FIG. 7 as the second embodiment was used. A quartz glass container with an internal diameter of 86 mm and an external diameter of 92 mm was used as the heat-resistant container, induction heating elements made from ferritic stainless steel 430 having magnetism were housed in the quartz glass container, and simultaneously an input water storage tank made from the same ferritic stainless steel 430 was set on the side of the steam inlet within the quartz glass container. Also, a copper pipe was connected to one end of the silicone hose as a connecting end, and this connecting end was airtightly connected to the steam inlet of the quartz glass container. Further, a switching regulator was connected to the solenoid as a high-frequency power supply unit so that a high-frequency power of 20 kHz can be supplied to the solenoid. The induction heating elements were obtained by making fine cuts in a strip of ferritic stainless 430 and twisting the resulting strip, and a proper number of induction heating elements were housed inside the quartz glass container. FIG. 17 is the whole photography of the superheated steam generation container used in this example.

An experiment of the superheated water vapor generation was performed using this apparatus. For the experiment, a switching regulator as the high-frequency power supply unit was started, thereby applying a high-frequency power of 20 kHz to the induction heating coil, and starting induction heating. Also, the water supply pump was started to allow cooling water to pass through the heat-resistant hose.

Frequency f=20 [kHz]

Coil applied voltage V=about 190 [V]

Current I=about 10.5 [A]

Distance between coil and heating elements GAP=14 [mm]

Time t=1800 [sec]

Pump applied voltage: 3V (about 10 ml/min) before boiling, and 5V (17 ml/min) after boiling Static characteristics of the coil during the experiment (during use of a resonant capacitor): Z[Ω]=3.892, Rs[Ω]=2.989, Ls[μH]=19.79, and Cp[μF]=3.198

Figure 18:
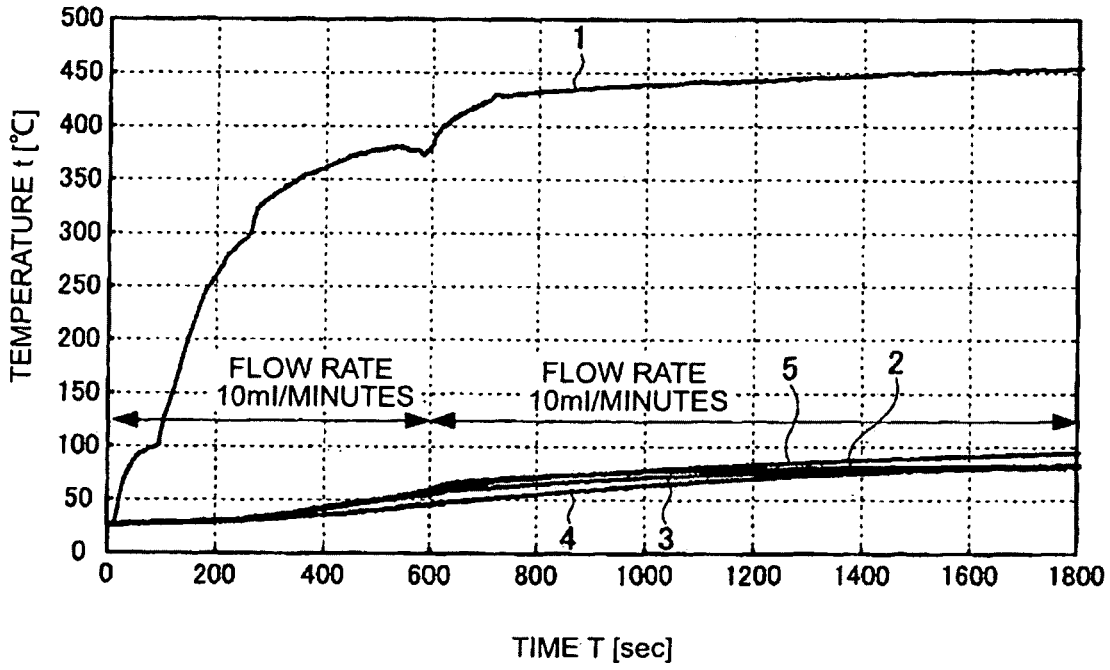
FIG. 18 is a graph of the temperature state of individual parts during the superheated steam generation operation by the superheated steam generator of the above Example 1.

As for this example 1, the results when the passage of time from the start of water passing and the temperature changes of individual parts of the apparatus were observed is shown in the graph of FIG. 18. Graph (1) shows the steam temperature of the superheated steam outlet, and Graphs (2) to (5) show the coil surface temperatures of individual parts (positions where reference numerals (2) to (5) are given in FIG. 1) which lead to the superheated steam outlet from the steam inlet.

As apparent from the graph of FIG. 18 it was confirmed that the superheated steam output temperature exceeds 450° C., and it was confirmed that all the surface temperatures of individual parts of the coil is 100° C. or less. In addition, it was confirmed that the water boiled within glassware during an experiment time of 600 seconds flowed rapidly.

EXAMPLE 2

An experiment facility was the same as that of Example 1 except that a small regulator was as the switching regulator, and one having the structure of the third embodiment shown in FIG. 8 was adopted as the induction heating elements within the superheated steam generation container. 42 disk-like fins were used.

The experimental conditions were as follows.

Frequency f=20 [kHz]

Coil applied voltage V=about 100 [V]

Current I=about 13.5 [A]

Distance between coil and heating elements GAP=14 [mm]

Time t=1800 [sec]

Pump applied voltage: 3 V (about 10 ml/min)

Static characteristics of the coil during the experiment (during use of a resonant capacitor): Z[Ω]=4.5774, Rs[Ω]=3.8756, Ls[μH]=19.615, and Cp[μF]=3.2284

Figure 19:
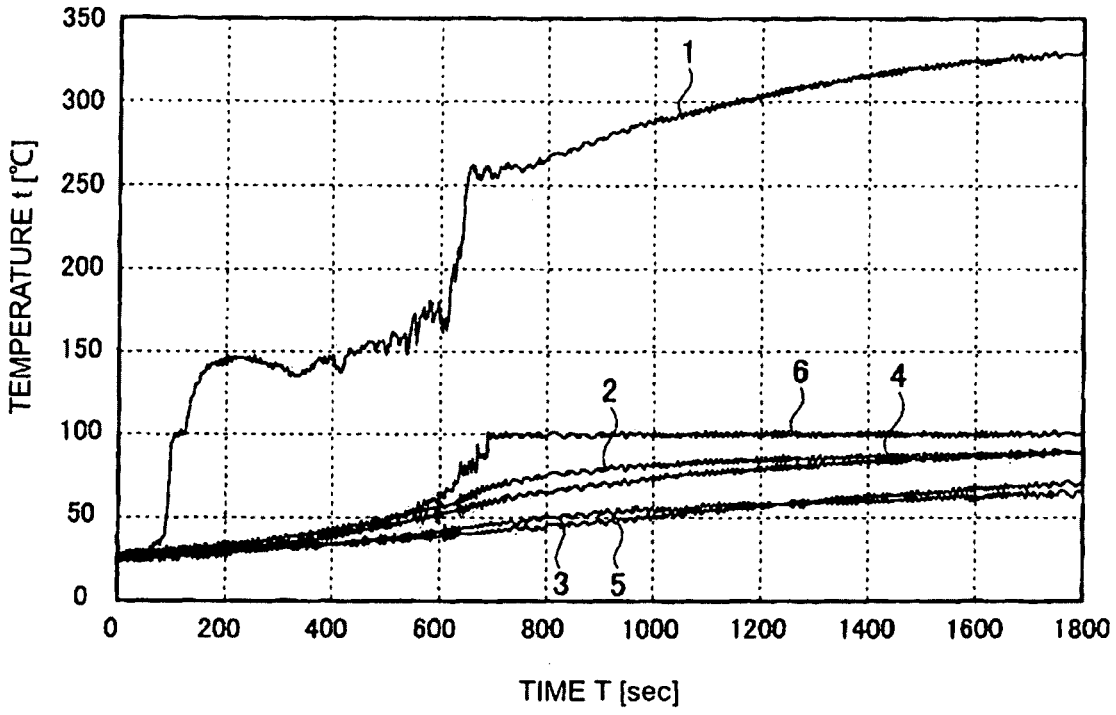
FIG. 19 is a graph of the temperature state of individual parts during the superheated steam generation operation by the superheated steam generator of Example 2 of the invention.

As for this example 2, the results when the passage of time from the start of water passing and the temperature changes of individual parts of the apparatus were observed as shown in the graph of FIG. 19. Graph (1) shows the steam temperature of the superheated steam outlet, and Graphs (2) to (5) show the coil surface temperatures of individual parts (positions where reference numerals (2) to (5) are given in FIG. 1) which lead to the superheated steam outlet from the steam inlet. Also, Graph (6) is the water temperature or steam temperature of a container inlet.

As apparent from the graph of FIG. 19, it was confirmed that superheated water vapor output temperature is a maximum of about 330° C. Further, it was confirmed that all the temperatures in portions (1) to (4) of the coil is 100° C. or less. Further, it was confirmed that, as input water boils, the output steam temperatures also becomes high.

What is claimed is:

1. A superheated steam generation container comprising:

one or more induction heating elements which generate heat by electromagnetic induction and which are housed within a heat-resistant container;

a hose which allows cooling water to pass therethrough, a heat-resistant tube mounted on an outer peripheral surface of the heat-resistant container, wherein the hose is wound around an outer peripheral surface of the heat-resistant tube; and an induction heating coil mounted on an outer peripheral surface of the hose such that the induction heating coil is in direct contact with the hose, wherein the induction heating coil induces current into said induction heating element to heat the cooling water within the hose such that the cooling water turns into steam, and wherein the hose is configured to introduce the steam into the heat-resistant container.

2. The superheated steam generation container according to claim 1, wherein the induction heating coil includes a litz wire.

3. The superheated steam generation container according to claim 1, wherein the heat-resistant container is a quartz glass container.

4. A superheated steam generator comprising:

one or more induction heating elements which generate heat by electromagnetic induction and which are housed in a heat-resistant container;

a hose which allows cooling water to pass therethrough, a heat-resistant tube mounted on an outer peripheral surface of the heat-resistant container, wherein the hose is wound around an outer peripheral surface of the heat-resistant tube;

a water supply unit for the cooling water, wherein the water supply unit is connected to a first end of the hose, and wherein a second end of the hose is connected to a steam inlet of the heat-resistant container;

an induction heating coil mounted on an outer peripheral surface of the hose such that the induction heating coil is in direct contact with the hose, wherein the induction heating coil induces current into said induction heating element to heat the cooling water within the hose such that the cooling water turns into steam, and wherein the hose is configured to introduce the steam into the heat-resistant container; and a high-frequency power supply unit connected to the induction heating coil.

5. The superheated steam generator according to claim 4, wherein the induction heating coil includes a litz wire.

6. The superheated steam generator according to claim 5, wherein the heat-resistant container is a quartz glass container.

7. A superheated steam generation method comprising:

passing cooling water through a hose that is wound around a heat-resistant tube mounted on an outer peripheral surface of the heat-resistant container that houses one or more induction heating elements that generate heat by electromagnetic induction, wherein an induction heating coil is mounted on an outer peripheral surface of the hose such that the induction heating coil is in direct contact with the hose;

applying high-frequency electric current to the induction heating coil, thereby induction-heating the one or more induction heating elements, and induction-heating the cooling water within the hose into steam;

introducing the steam into the heat-resistant container; and heating the steam with the one or more induction heating elements to generate superheated steam.

8. The superheated steam generation container of claim 1, wherein the one or more induction heating elements include a plurality of circular fins.

9. The superheated steam generation container of claim 8, wherein each of the plurality of circular fins includes a steam passage port.

10. The superheated steam generation container of claim 9, wherein a first steam passage port on a first circular fin differs in position from a second steam passage port on a second circular fin that is adjacent to the first circular fin.

11. The superheated steam generation container of claim 1, wherein the hose is maintained at a temperature of 100° Celsius or less during operation.

12. The superheated steam generation container of claim 2, wherein the litz wire includes a polyethylene coating.

13. The superheated steam generation container of claim 2, wherein the litz wire includes a polyurethane coating.

14. The superheated steam generation container of claim 1, wherein the heat-resistant container is non-magnetic.

15. The superheated steam generation container of claim 1, further comprising an input water storage tank housed within the heat-resistant container.

16. The superheated steam generation container of claim 15, wherein the input water storage tank is made from a magnetic material.

* * * * *